United States Patent [19]

Greenblatt

[11] Patent Number: 4,733,508

[45] Date of Patent: Mar. 29, 1988

[54] MULTI-SIDED BUILDING CONSTRUCTION

[76] Inventor: Kenneth A. Greenblatt, 335 S. Pasadena Ave., Azusa, Calif. 91702

[21] Appl. No.: 926,099

[22] Filed: Nov. 3, 1986

[51] Int. Cl.[4] ..... E04B 1/60

[52] U.S. Cl. ..... 52/90; 52/236.1

[58] Field of Search ..... 52/82, 236.1, 90, 92, 52/262

[56] References Cited

U.S. PATENT DOCUMENTS

| | | | |
|---|---|---|---|
| 1,806,354 | 5/1931 | Lange | 52/82 |
| 2,256,050 | 9/1941 | Hansen | 52/64 |
| 2,358,704 | 9/1944 | Goudy | 52/236.1 |
| 2,440,449 | 4/1948 | Raemer | 52/82 |
| 3,908,329 | 9/1975 | Walters | 52/82 |
| 4,076,432 | 2/1978 | Glaser | 403/171 |
| 4,173,855 | 11/1979 | Raptoplous | 52/236.1 |
| 4,229,915 | 10/1980 | Snow et al. | 52/92 |
| 4,275,534 | 6/1981 | Porter | 52/82 |
| 4,357,118 | 11/1982 | Murray | 403/407.1 |
| 4,592,671 | 6/1986 | Daum | 52/81 |

FOREIGN PATENT DOCUMENTS

| | | | |
|---|---|---|---|
| 1125648 | 5/1919 | United Kingdom | 52/82 |

*Primary Examiner*—James L. Ridgill, Jr.
*Attorney, Agent, or Firm*—Edward E. Roberts

[57] ABSTRACT

A multi-sided building construction assembly having a plurality of side wall units, a like plurality of generally triangularly configured roof panels, a like plurality of combination union brackets, and a like plurality of footing brackets, with a roof center hub support having a like number of sides. The combination union bracket is configured for being received and connected atop the adjacent edges of adjacent side wall units, and include a pair of upwardly and angularly disposed roof connecting brackets. The roof center hub support has a number of side edges, each of which is disposed at the angle necessary for the pitch of the roof panel, which is supported at one end by the brackets of the union bracket member, and at the other end by the roof center hub support. The footing brackets include angularly disposed arms at the appropriate angle for the polygon, and attach beneath adjacent edges of adjacent side wall units and may be attached to a concrete slab. Footing straps are included for attachment to the footing brackets to maintain structure alignment if the structure is not to be erected atop a slab of other foundation.

17 Claims, 8 Drawing Figures

MULTI-SIDED BUILDING CONSTRUCTION

BACKGROUND OF THE INVENTION

The background of the invention will be discussed in two parts.

1. Field of the Invention

This invention relates generally to multi-sided building structures and more particularly to a new and improved gazebo construction assembly and method.

2. Description of the Prior Art

Polygonal structures of recent vintage are usually provided in disassembled form, such as kits, which include the necessary construction members, side panels, roof panels, and hardware. Gazebos having four, five, six or even up to eight sides are typical of such multi-sided structures. While some gazebos are formed of wood in large part, more recently such gazebos have been formed of metallic framing, such as steel or aluminum tubing or circular or rectangular cross-section, with metal, wood or plastic panels for the roof, and sometimes the side walls.

U.S. Pat. No. 1,806,354, issued May 19, 1931 to Lange for a "Portable Building" shows an early vintage wood structure of eight sides, formed primarily of wood in prefabricated sections. Pre-bent angle irons support the juncture of the roof and side panels.

Another wood structure is shown and described in U.S. Pat. No. 3,908,329, issued to Walters, on Sept. 30, 1975 for a "Polygonal Building Construction," the construction being reinforced by use of rafter and perimeter cabling tensioned by means of turnbuckles.

U.S. Pat. No. 4,173,855, issued to Raptoplous on Nov. 13, 1979 for a "Prefabricated Building Structure," which is a gazebo having an octagonal configuration with support for the sides and roof provided by bent metallic structural members.

Another multi-sided building construction is shown and described in U.S. Pat. No. 4,275,534, issued to Porter on June 30, 1981 for "Hexagonal Building Structures," the structural support members being formed of bent and welded metal members.

U.S. Pat. No. 4,357,118, issued to Murray on Nov. 2, 1982, entitled "Connecting Assembly for Geodesic Dome Framework Construction," and shows a connecting member for retaining six construction members in the proper angular orientation relative to one another for such constructions.

A similar connecting member is shown and described in U.S. Pat. No. 4,592,671, issued to Daum on June 3, 1986 for "Connector Plate for Fabricating Buildings," the connecting plate having one of several configurations for supporting several generally orthogonally and transversely directed construction members.

Such prior art gazebo type structures, and particularly the prefabricated systems, have utilized an inordinate number of complex and heavy construction members which have required skilled installers. In addition, such prefabricated systems have utilized elaborate and expensive connector members, as evidenced by the last two of the above patents.

It is accordingly an object of the present invention to provide a new and improved multi-sided construction assembly.

It is another object of the present invnetion to provide a new and improved roof to side panel connector member for use in multi-sided construction assemblies.

It is still another object of the present invention to provide a new and improved economical, gazebo construction assembly kit which may be readily assembled by relatively unskilled workers.

SUMMARY OF THE INVENTION

The foregoing and other objects of the invention are accomplished by providing a multi-sided construction assembly having a plurality of side wall units, a like plurality of generally triangularly configured roof panels, a like pluarlity of combination union brackets, and a like plurality of footing brackets, with a roof center hub support having a like number of sides. The combination union bracket is configured for being received and connected atop the adjacent edges of adjacent side wall units, and include a pair of upwardly and angularly disposed roof connecting brackets.

The roof center hub support has a number of side edges, each of which is disposed at the angle necessary for the pitch of the roof panel, which is supported at one end by the brackets of the union bracket member, and at the other end by the roof center hub support. The footing brackets include angularly disposed arms at the appropriate angle for the polygon, and attach beneath adjacent edges of adjacent side wall units and may be attached to a concrete slab. If the structure is not to be assembled atop a concrete slab, footing straps are provided for attachment to the leg footing brackets for keeping the wall and legs equally spaced and aligned while acting as a band around the structure.

Other objects, features and advantages of the invention will become apparent from a reading of the specification when taken in conjunction with the drawings, in which like reference numerals refer to like elements in the several views.

DESCRIPTION OF THE PREFERRED EMBODIMENTS

Figure 1:
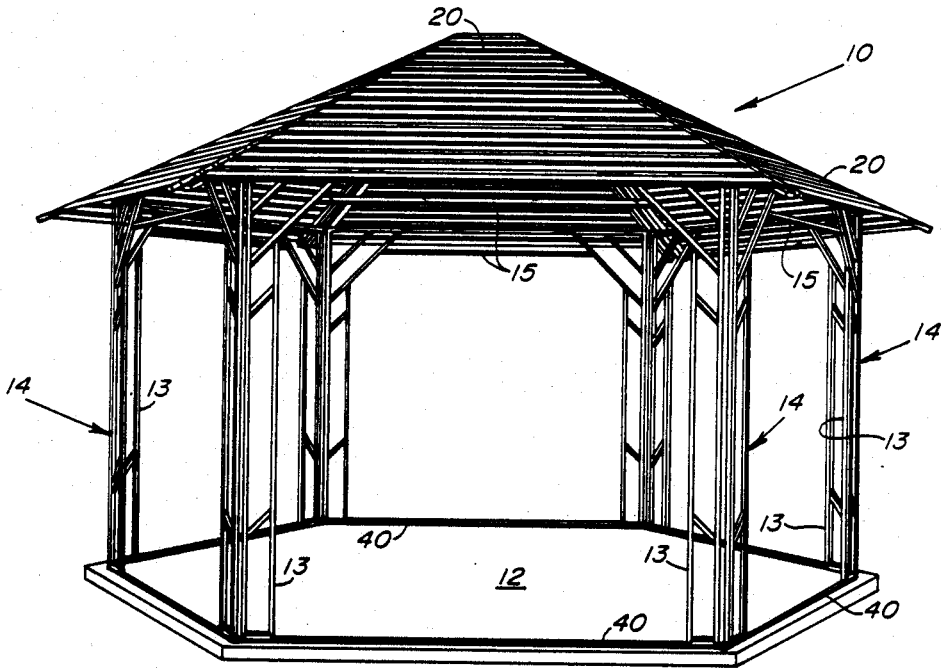
FIG. 1 is a perspective view of a multi-sided construction assembly according to the invention.
Figure 6:
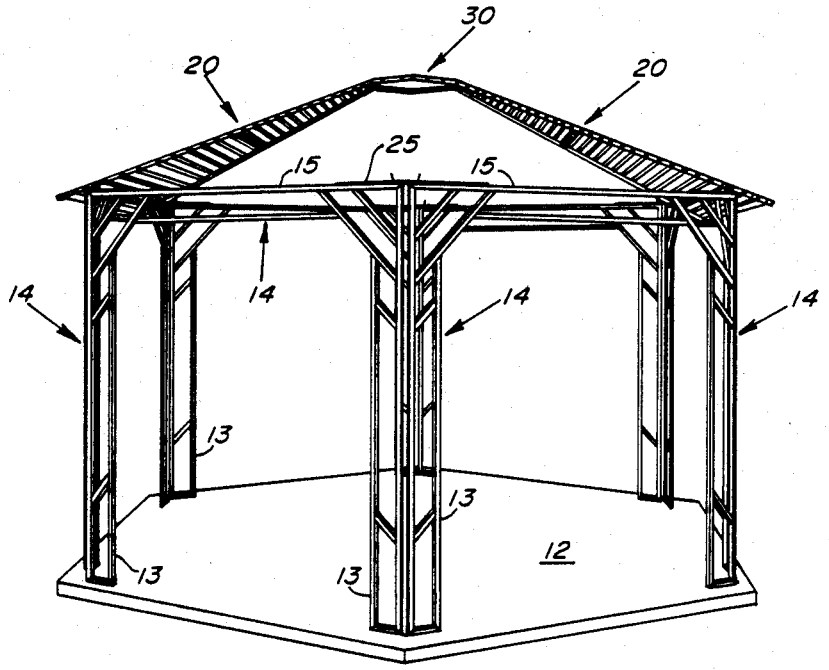
FIG. 6 is a perspective side view of the structure of FIG. 1, with only two roof panels attached.

Referring now to the drawings, and particularly to FIGS. 1 and 6, there is shown a hexagonally configured, or six-sided gazebo, generally designated 10, configured for support on a suitable surface such as a concrete slab 12, or the like. The structure 10 includes a plurality of generally identically configured side wall sections 14, six in all, each of which can be formed as a framework of welded metal tubing, such as rectangular or square tubing, to form a wall section of generally rectangular side elevation. The framework of each wall section 14 includes leg sections 13 and a cross-beam section 15 which defines a generally open access area.

The wall sections 14 are joined, as will be hereafter described, in generally vertical orientation for support by the lower edges of the legs 13 on the slab 12. At the upper edges of the wall sections 14, a roof is formed of a plurality, six in all, of roof panels 20 (See also FIG. 5), each of which is of a truncated generally triangular configuration.

In accordance with the present invention, there are provided a minimum number of connecting members required for construction of the gazebo 10, with the main components, that is the wall sections 14 and the roof panels 20 being prefabricated. As will be described, the interconnection of the main components is readily accomplished by a plurality of combination union brackets 25 (See FIG. 2), a compression ring or roof center hub support 30 (See FIGS. 3 and 4), a plurality of footing brackets 35 (See FIG. 8) and, if necessary, a plurality of spreaders or footing straps 40 (shown in FIGS. 1 and 8), in the event the structure 10 is not to be secured to the slab 12. As will become apparent, each of the interconnecting members is simply configured, of welded bar stock or rectangular tubing, with no complex interconnection arrangements required.

Figure 2:
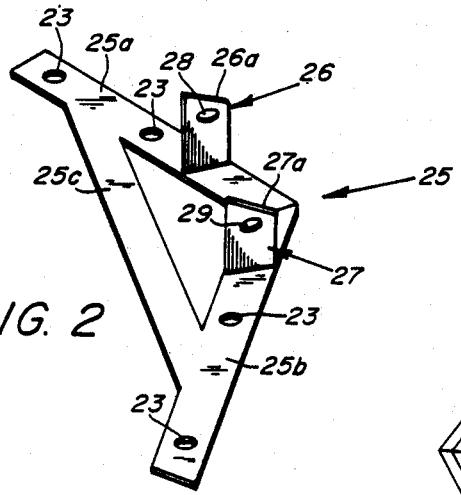
FIG. 2 is a perspective view of the combination union bracket used in the assembly of the structure of FIG. 1.

Referring now to FIG. 2, there is shown, in perspective view, the combination union bracket 25, which is formed of bar stock, with two arm portions **25*a* and 25*b* endwise welded to form an angle iron or angle strap having an angle suitable for the angle between adjacent wall sections 14 of a hexagonal configuration, that is 120 degrees. The arms 25*a* and 25*b* are interconnected by an angularly disposed cross-piece 25*c*** which forms a truss support therefor.

The arms **25*a*, 25*b* and cross-piece 25*c* lie in a common plane, and include suitable bolt receiving apertures 23. A pair of short bar-shaped bracket members 26 and 27 have the first ends thereof welded to the upper surfaces of the arms 25*a* and 25*b*, respectively, with each bracket member 26, 27 extending at a compound angle relative to the plane of the upper surfaces of the arms 25*a* and 25*b*. For example, the lower edge of the bracket member 26 is transverse to, but not perpendicular to, the opposing edges of the arm 25*a*, and the plane of the bracket member 26 is at an angle to, but not perpendicular to the plane of the arm 25*a* (See also FIG. 7**).

Similarly, the bracket 26 lies at a compound angle to the plane of the arm **25*b*. As better illustrated in FIG. 7, the bracket members 26 and 27 extend in an upward generally diverging manner relative to the plane of the arms 25*a* and 25*b*. The upper edges 26*a* and 27*a* of the bracket members 26 and 27 are tapered at an angle generally corresponding to the desired pitch of the roof. Each bracket member 26, 27, includes a suitable bolt receiving aperture 28, 29, respectively. FIG. 6 shows bracket 25** in place without the roof.

Figure 3:
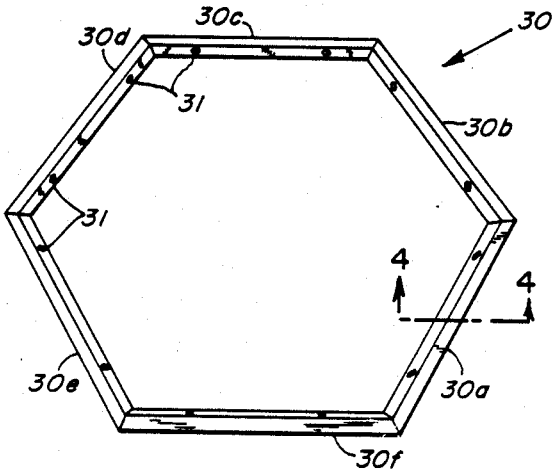
FIG. 3 is a plan view of the roof center hub support used in the assembly of the structure of FIG. 1.
Figure 4:
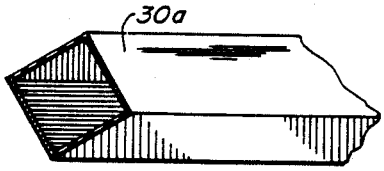
FIG. 4 is a cross sectional view of the hub support of FIG. 3 as viewed generally along line 4—4 thereof.

FIGS. 3 and 4 show the details of the compression ring or roof center hub support member 30, which is formed of rectangular or square tubing sections **30*a*–30*f* formed and interconnected in an open hexagonal configuration. Each section 30*a*–30*f* has a pair of aligned bolt receiving apertures 31 extending therethrough for interconnection with an edge of the roof panels 20 as will be described. As shown in FIG. 4, the outer surface of each section of the support 30 is disposed at an angle to the plane of the support 30, this angle being selected to correspond to the desired pitch of the roof with a roof panel 20 coupled thereto. The hexagonal support 30** is formed by cutting the ends of the tubing at compound angles and welding to obtain the desired edge surface angle for the required roof pitch.

Figure 5:
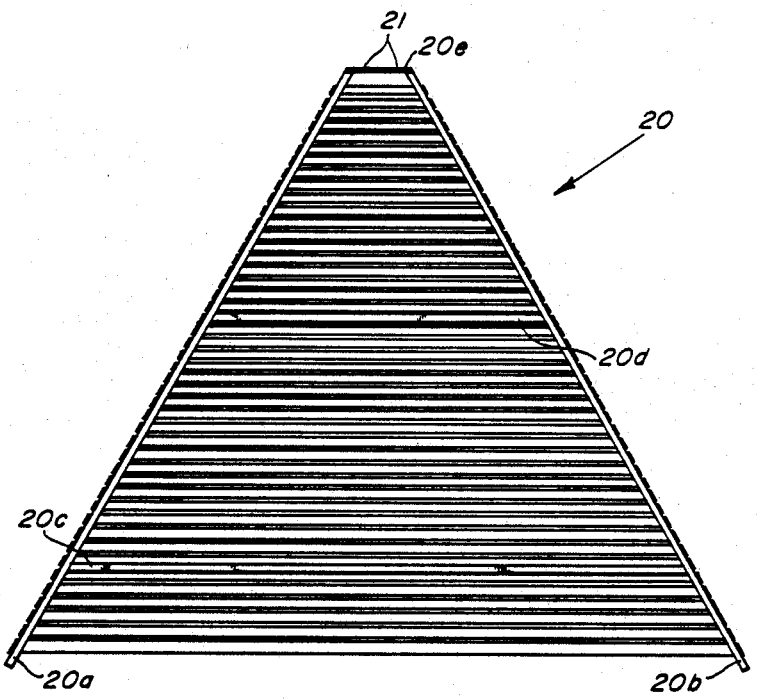
FIG. 5 is a plan view of the underside of a roof panel used in the construction of the structure of FIG. 1.

Referring now to FIG. 5, there is shown a roof panel 20, which is generally triangular in plan view, with a truncated apex. The roof panel 20 is formed with a framework including first and second tubular side members **20*a* and 20*b*, interconnected by tubular lateral spacing members 20*c* and 20*d* intermediate the ends of sides 20*a* and 20*b*. The longer lateral spacing member 20*c* is positioned at a point which generally aligns with an upper edge of one of the cross-beam portions 15 of the wall sections 14**, when assembled thereto.

The upper apex end **20*e* of roof panel 20 is formed of bar stock with a pair of apertures 21 extending therethrough in spaced relation for alignment with the apertures 31 in a section 30*a*–30*f* of the roof hub support 30, with the outer surface of the engaged section 30*a*–30*f* in abutting relation with the surface of the apex edge 20*e*, the length of end 20*e* generally corresponding to the length of one of the sections 30*a*–30*f* of the roof center hub support 30. The parts 20*a*–20*e*** are suitably welded together.

The outer surface of the framework of roof panel 20 may be covered with any suitable material, and in the embodiment shown, the roof panel 20 is covered with closely spaced parallel straps or strips 22 of a suitable plastic material, such as vinyl, for serving primarily as a sun shade, the opposite ends of each vinyl strip 22 being suitably wound about the sides **20*a* and 20*b*** and attached to the underside thereof, such as by screws.

Referring now to FIGS. 1, 2 and 6 through 8, for erection of the assembly, the combination union bracket 25 has one arm **25*a* thereof bolted, generally bolts 24 (FIG. 7) through apertures 23 (FIG. 2), to the upper corner edge of the cross-beam portion 15 of one of the wall sections 14. This wall section 14 and another wall section 14 are raised to a vertical position with the lower ends 13*a* of the legs 13 of the wall sections 14 resting on the slab 12 in proximate relation and the bracket 25 has the other arm 25*b* thereof bolted to the adjacent corner of the cross-beam portion 15 of wall section 14 (See FIG. 7). The other five brackets 25 and the other four wall sections 14** are then similarly bolted to one another.

The combination union brackets 25 perform four functions. Each bracket 25 connects adjacent wall sections 14 together. It connects the wall sections 14 together at the proper angle in relation to one another. It hold the lower ends of the roof panels 20 at their perimeter to the cross-beam portions 15 of the wall sections 14, and lastly, with all wall sections 14, roof panels 20, roof center hub support 30 and brackets 25 bolted together, it acts as a tension band or ring around the entire gazebo structure 10 so as to support the weight of the roof without any poles, trusses or cables that would otherwise be used in other constructions for support of roof weight or snow load or the like.

After the side wall sections 14 are connected by means of the brackets 25, a section **30*a* of the roof center hub support 30 is connected and bolted to one end 20*e* of a roof panel 20, with the outer surface of the section 30*a* in surface abutting relation with the broad surface of the bar-shaped edge 20*e*. The roof panel 20, with roof hub support 30 attached is then lifted into position atop one cross-beam portion 15 of wall section 14 until the lateral spacer 20*c* is in proximate relation to the upper horizontal edge of the cross-beam portion 15 of wall section 14, and tilted until the plane of the roof center hub support 30** is about horizontal.

A second roof panel 20 is then lifted atop the cross-beam portion 15 of the opposite wall section 14, and moved upwardly until the edge 20*e* thereof is in proximate relation to the opposite section 30*d* of the hub support 30, whereupon the bar-shaped edge 20*e* is bolted to the section 30*d*, as shown in FIG. 6, with bolts passing through aligned apertures 21 and 31.

Figure 7:
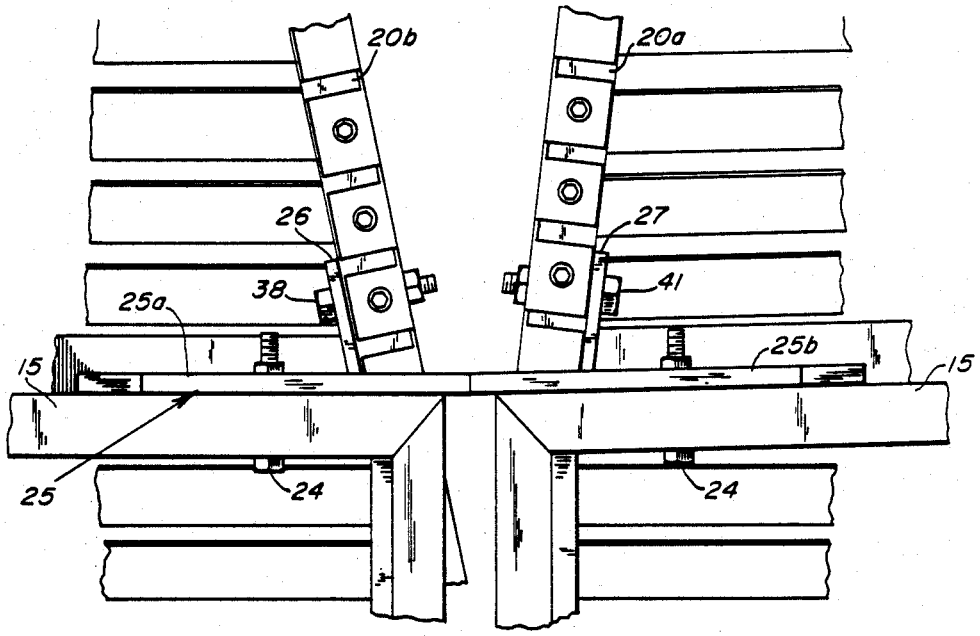
FIG. 7 is an enlarged partial view from the interior of the structure of FIG. 1 showing the details of attachment of the bracket of FIG. 2.

As shown in FIG. 7, the sides 20*b* and 20*a* of adjacent roof panels 20 are provided with apertures for receiving bolt members 38 and 41, which pass through the apertures 28 and 29 of the bracket members 26 and 27, respectively, of the combination union bracket 25, thus, in conjunction with the hub support 30, supporting the roof panels 20 at the proper roof pitch. Each roof panel 20 is, in turn, bolted to the respective bracket 25 and roof center hub support 30, until the roof is completed.

With the roof panels 20 thus assembled, the roof center hub support 30, has two functions. Initially, it connects and supports all roof panels 20 together at the center of the gazebo structure 10. In addition it also functions to provide each roof panel 20 with the desired pitch or angle, as a consequence of the way that the compound angled sections 30*a*–30*f* are cut and welded together, to thus provide a unitary structural member which eliminates the need for roof supports, poles, trusses or cables and turnbuckles. The downward weight of the roof panels 20 is transferred through the roof panels 20 to the combination brackets 25. Since there is no hinging effect at the hub support 30, the gazebo structure 10 of the present invention is a rigid, structurally sound unit.

Figure 8:
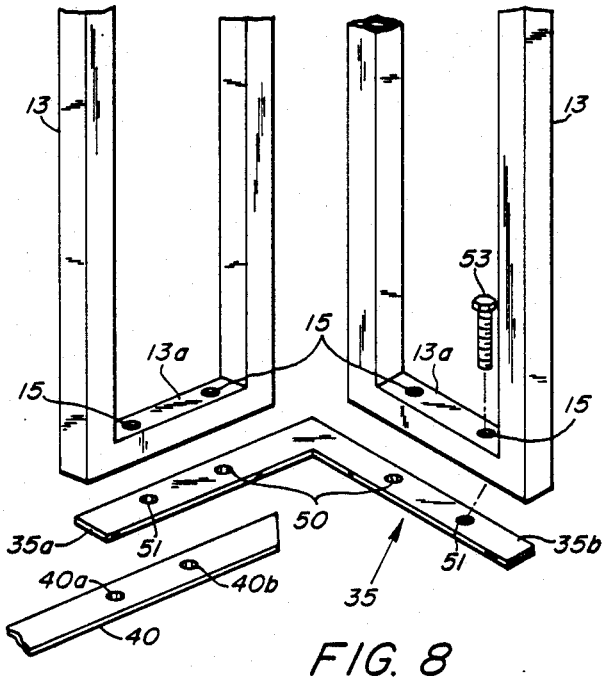
FIG. 8 is a partial perspective view of the lower adjacent edges of the side walls of the structure of FIG. 1 with a footing bracket prior to assembly thereof.

After assembly of the walls and roof, as shown in FIG. 8, the lower tubing portions 13*a* of the leg portions 13 of adjacent wall sections 14, which are each provided with aligned pairs of apertures 15, are interconnected by means of footing brackets 35, which are formed of elongate bar stock welded together in a common plane to form an angle strap member having an angle corresponding to the angle between adjacent wall sections 14, that is, 120 degrees for a hexagonal, or six-sided gazebo 10. Each arm 35*a*, 35*b* is formed with a pair of aligned apertures, 50, 51, spaced a distance corresponding to the distance between apertures 15 in each lower leg section 13*a* of wall sections 14. The apertures 51 are threaded apertures for receiving threaded fasteners such as bolts 53.

The footing brackets 35 serve two purposes, one of which is to secure the leg portions 13 of wall sections 14 legs together at the proper angle, and the other function is to enable securing the structure to the concrete slab 12, or to the footing straps 40, as the case may be. For attachment to a concrete slab, or other foundation, the footing bracket 35 is positioned under the lower short horizontally extending leg sections 13*a* of the wall sections 14, and bolts 53 are passed through the openings 15 of sections 13*a* into engagement with the threaded apertures 51 of bracket 35. The inner apertures 15 are then in alignment with the apertures 50 of the bracket 35, and suitable concrete anchor fasteners may be passed through these aligned openings for securing the gazebo to the concrete slab 12.

In the event, the leg portions 13 of the wall sections 14 are not to be bolted through the footing brackets 35 to the slab 12, then the footing straps 40 (See FIGS. 1 and 8), are utilized, the footing straps being elongate bar shaped members, having apertures 40*a* and 40*b* in the ends thereof for alignment with the apertures 15 in the lower leg sections 13*a*, as well as the apertures 50 and 51 of brackets 35. The length of the footing straps 40 is generally equal to the slab length of a wall section 14, and is bolted at both ends together with the leg footing bracket 35 and wall section 14 so that one end of the footing strap 40 is bolted to one side of one leg footing bracket 35, and the other end of the footing strap 40 is bolted to a leg footing bracket on the opposite end of the wall section 14, thus keeping the wall and legs equally spaced and aligned while acting as a band around the footing of the gazebo structure 10. Aperture 40*b* normally will be threaded.

As shown and described, the gazebo structure 10 may be provided as a prefabricated kit direct to the user, and with the minimum number and complexity of the interconnecting members, assembly may be readily accomplished by semiskilled individuals, or even unskilled individuals able to assemble a bicycle. Furthermore, with the welding square tubing and bar stock utilized in the framework of the structure 10, the cross-beam portions 15 of the wall sections 14 are sufficiently strong to support items, such as a swing or the like.

While there has been shown and described a preferred embodiment, it is to be understood that various other adaptations and modifications may be made within the spirit and scope of the invention.

What is claimed is:

1. A multi-sided building structure assembly comprising:

a predetermined number of wall sections of generally equal outside dimension, each of said wall sections including first and second generally identical sections;

the same number of generally triangularly configured roof panels, each of said roof panels having first and second sides and a truncated apex edge having a surface;

the same number of generally identically configured bracket members, each of said bracket members having first means for interconnecting the upper ends of adjacent ones of said first and second sections in a predetermined angular relation for forming each of said wall sections, and second means for connection to adjacent ones of said roof panel sides adjacent the lower ends of said roof panels at each corner of the side opposite said truncated apex edge; and a roof center hub support member having the same number of generally bar-shaped sections interconnected to form a regular geometrical configuration having a number of sides equal to said predetermined number, each of said sections having an outer surface disposed at a given angle to the plane of said support member for connection to said apex edge surface in surface abutting relation, the angle of said outer surfaces corresponding to the pitch of the roof panels.

2. The combination according to claim 1 wherein said structure further includes bracket means attachable to the bottoms of adjacent ones of said first and second sections of wall sections for maintaining the lower parts of said first and second sections in a predetermined angular relation.

3. The combination according to claim 2 wherein said structure further includes footing means attachable to said bracket means for maintaining the lower parts of said wall sections in a predetermined spaced relation.

4. The combination according to claim 1 wherein said hub support member is formed of metallic sections of generally rectangular cross-section welded together to form a regular multi-sided polygon.

5. The combination according to claim 4 wherein said metallic sections are square metal tubing.

6. The combination according to claim 1 wherein said first means of said bracket members include first and second generally bar shaped arm portions having angled edges welded together in coplanar relation, with each of said arm portions having means therein for fastening to the upper ends of said first and second sections of said wall sections.

7. The combination according to claim 6 wherein said second means includes bracket portions affixed to said arm portions and extending in a plane transverse to the plane of said arm portions.

8. The combination according to claim 7 wherein said bracket portions includes a first generally bar-shaped bracket portion welded to one of said arm portions, and a second generally bar-shaped bracket portion welded to the other of said arm portions.

9. A multi-sided building structure assembly comprising:

a plurality of generally identically dimensioned wall sections, each of said wall sections being formed of welded tubular metal and having a pair of leg portions and a cross-beam portion;

a plurality of generally triangularly configured roof panels, each of said roof panels having first and second sided and a truncated apex edge having a surface;

a plurality of generally identically configured bracket members, each of said bracket members having first and second generally coplanar bar shaped arm portions disposed at an angle, and at least one bracket portion on each of said arm portions extending in a direction generally transverse to the plane of said arm portions, each of said arm portions being configured for connection to the upper corner of the cross-beam portion of an adjacent one of said wall sections, said bracket portions being configured for connection to the sides of adjacent ones of said roof panels; and a roof center hub support member formed from a plurality of sections of generally rectangular cross-section joined together at the ends thereof to form an open regular multi-sided polygon, each of said sections having an outer surface disposed at a given angle to the plane of said support member for connection to said apex edge surface in surface abutting relation, the angle of said outer surfaces and the angle of connection of said roof sides to said bracket portions defining the pitch of the roof panels.

10. The combination according to claim 9 wherein said structure further includes other bracket means attachable to the bottoms of adjacent ones of said wall sections for maintaining the lower parts of said wall sections in a predetermined angular relation.

11. The combination according to claim 10 wherein said structure further includes footing means attachable to said other bracket means for maintaining the lower parts of said wall sections in a predetermined spaced relation.

12. In a prefabricated building construction having a given number of adjacent wall sections having a predetermined angle therebetween and a roof comprising a given number of generally triangular roof panels having first and second sides and an apex, said roof panels configured for coupling together at the apexes thereof and for being attached at a given pitch relative to said wall sections, tension band means interconnecting said wall sections and said roof panels for maintaining the individual alignment of said wall sections and said roof panels, and for supporting the weight of said roof, and wherein said tension band means includes a plurality of connector assemblies, each of said connector assemblies comprising first and second generally coplanar arm portions angularly positioned relative to one another at said predetermined angle for attachment to said first and second arm portions, respectively, for coupling to the lower edges of the sides of said roof panels for maintaining said roof panels at said pitch.

13. The combination according to claim 12 wherein said bracket portions of said connector are positioned at an angle transverse to the plane of the arm portions.

14. The combination according to claim 13 wherein said building construction further includes bracket means attachable to the bottoms of adjacent ones of said wall sections for maintaining the lower parts of said wall sections in a predetermined angular relation.

15. The combination according to claim 14 wherein said building construction further includes footing means attachable to said bracket means for maintaining the lower parts of said wall sections in a predetermined spaced relation.

16. The connector according to claim 15 wherein said first and second bracket portions are generally bar-shaped members, each having one end thereof welded to one of said arm portions, and wherein said first and second arm portions are formed of bar-shaped metal welded together.

17. The combination of claim 16 wherein said building is a regular hexagon, and wherein six of said connector assemblies are provided.

* * * * *